US005523200A

United States Patent [19]

Hahm et al.

[11] Patent Number: 5,523,200

[45] Date of Patent: Jun. 4, 1996

[54] FINE GRAIN BROMIDE EMULSIONS AS CARRIERS FOR PHOTOGRAPHICALLY USEFUL INGREDIENTS ADDED DURING EMULSION FINISHING

[75] Inventors: Paul T. Hahm, Hilton; Walter H. Isaac, Penfield; Heinz E. Stapelfeldt, Pittsford, all of N.Y.

[73] Assignee: Eastman Kodak Company, Rochester, N.Y.

[21] Appl. No.: 390,450

[22] Filed: Feb. 17, 1995

[51] Int. Cl.[6] ..... G03C 1/05; G03C 1/34

[52] U.S. Cl. ..... 430/569; 430/567; 430/568; 430/948; 430/570; 430/599; 430/607; 430/614; 430/931; 430/933; 430/950; 430/631

[58] Field of Search ..... 430/567, 569, 430/568, 948, 570, 599, 607, 614, 931, 933, 950, 631

[56] References Cited

U.S. PATENT DOCUMENTS

| | | | |
|---|---|---|---|
| 4,863,844 | 9/1989 | Okumura et al. | 430/569 |
| 4,865,962 | 9/1989 | Hasebe et al. | 430/567 |
| 5,043,258 | 8/1991 | Ihama et al. | 430/567 |
| 5,070,008 | 12/1991 | Maekawa et al. | 430/567 |
| 5,284,745 | 2/1994 | Ohshima | 430/605 |
| 5,391,474 | 2/1995 | Haefner et al. | 430/569 |

FOREIGN PATENT DOCUMENTS

| | | |
|---|---|---|
| 2-103032 | 4/1990 | Japan . |

*Primary Examiner*—Mark F. Huff
*Attorney, Agent, or Firm*—Paul A. Leipold

[57] ABSTRACT

The invention generally relates to a method of silver halide grain finishing comprising providing a high chloride silver halide grain emulsion and adding a silver bromide fine grain Lippmann emulsion during the chemical sensitization heat cycle for each grain wherein said fine grain emulsion has a photographically useful compound adhered to said fine grain Lippmann emulsion.

15 Claims, No Drawings

FINE GRAIN BROMIDE EMULSIONS AS CARRIERS FOR PHOTOGRAPHICALLY USEFUL INGREDIENTS ADDED DURING EMULSION FINISHING

FIELD OF THE INVENTION

This invention relates to the finishing of silver halide emulsions. It particularly relates to the chemical sensitization of silver halide emulsions.

BACKGROUND OF THE INVENTION

In the formation of silver halide emulsions suitable for use in photographic materials, it is necessary to sensitize the emulsions. Chemical sensitization is utilized to improve the photo efficiency of the emulsions. Spectral sensitization is utilized to make grains sensitive to specific wavelengths of light. The addition of chemical and spectral sensitizing materials to silver halide grains normally is referred to as finishing of the grains. During finishing, other additives are also introduced into the emulsions, such as antifoggants, coating aids, ripeners, supersensitizers, and surfactants.

The application of heat during emulsion finishing has a tendency to raise the minimum fog level of unexposed areas. Fog also may increase in an emulsion during storage. Therefore, the use of antifoggants is necessary to minimize these effects. Such antifoggants are discussed in Research Disclosure 36544 of September 1994 in Section VII.

The antifoggants generally are added during the finishing process after chemical sensitization and prior to, during, or after the spectral sensitization. There is a continuing need for improvements in the efficiency of antifoggants.

It is known in the formation of high chloride grains (above 90%) to utilize bromide as a material added during finishing. It is added to the grain surface in order to improve the adsorption of sensitizing dyes onto the grain surface, enhance the speed/fog performance of the grains, and also improve reciprocity. Generally this material is added as a sodium or potassium bromide salt. It is also known that bromide may be added to the emulsion by the addition of a Lippmann (fine grain) emulsion to the finish. Such a process is illustrated in U.S. Pat. No. 4,865,962. Other photographic materials may be with a fine grain emulsion as shown in Konica JP 02- 103,032 (1990).

Generally modern negative-working color photographic paper utilizes high chloride emulsions. Such emulsions, while allowing rapid development and high quality images, are subject to fog upon storage.

Problem to be Solved by the Invention

There is a continuing need for improvements in Dmin of negative-working photographic papers by decreasing the fog. Particularly, there is a need to prevent the increase of fog during storage of such papers prior to use. There is also a need to more efficiently use known antifoggants.

SUMMARY OF THE INVENTION

The invention provides a method of silver halide grain finishing comprising providing a high chloride silver halide emulsion and adding a silver halide fine grain emulsion during the chemical sensitization heat cycle for said emulsion wherein said fine grain emulsion has a photographically useful compound adhered to the grains of said fine grain emulsion.

Advantageous Effect of the Invention

The invention provides better performance of silver halide emulsion during keeping. The papers maintain a low Dmin during storage. Further, the invention provides efficient utilization of antifoggants and better control of delivery of antifoggants to the grains. The invention also results in decreased speed change of the emulsions during storage.

DETAILED DESCRIPTION OF THE INVENTION

The invention utilizes a fine grain silver bromide salt that is added to a high chloride emulsion during finishing. The host high chloride emulsion typically will comprise greater than 95 mole percent silver chloride and preferably comprises about 99 mole percent silver chloride. The fine grain silver bromide, also known as a Lippmann emulsion, has an average size range of between about 0.03 and about 0.1 microns. The preferred fine grain emulsion is greater than 98 mole percent silver bromide. The fine grain emulsion is added during the finishing of the emulsion after chemical sensitization. It may be added at any portion of the finishing cycle after heating for chemical sensitization. It is preferred that the fine grain bromide emulsion be added during the heat cycle of finishing after the chemical sensitizer has been added. The Lippmann bromide also could be added during cool down of the emulsion after chemical sensitization if there is to be further heating of the emulsion prior to use at which time the bromide would be deposited on the surface of the chloride grains. The heat cycle finishing temperature typically will be between about 50° and about 80° C. It is preferred that the upper temperature of the finish heat cycle when the fine grain bromide emulsion is added be between about 55° and about 65° C. in order to provide the best speed/fog performance and reciprocity performance of the finished emulsion.

The amount of fine grain silver bromide added to the emulsion may vary between about 0.1 and about 3 mole % of total silver in the finished emulsion. A preferred range is between about 0.3 and about 1.5 mole % of total silver in the emulsion for best speed/fog performance and reciprocity performance. The host chloride emulsion onto which the bromide from the fine grain silver bromide is deposited may be a cubic or tabular emulsion. The host high chloride emulsion onto which the halide (bromide) of the fine grain silver halide is deposited may be a cubic (or octahedral) or tabular emulsion. The halide composition of the host high chloride emulsion may be pure silver chloride or it may contain small amounts (up to 1–2 mole %) of another halide such as bromide, iodide or a combination thereof. It will have an average size range generally between about 0.2 and 1.5 microns for cubic grains and between about 0.5 and about 3.5 micron average equivalent circular diameter (ECD) for tabular grains. The preferred ranges are an average size of between about 0.3 and 1.2 microns for the cubic grains and between about 0.1 and 2.5 microns average equivalent circular diameter for the tabular grains. The preferred ranges give a better result, as they provide a desired balance of speed and imaging efficiency. Cubic as used herein is intended to include non-tabular grains such as cubic, pseudocubic, tetradecahedral, octahedral, and cubo-octahedral.

It would advantageous to use the invention in combination with emulsions with high sensitivity such as high chloride [100] tabular grain emulsions, as is described in U.S. Pat. Nos. 5,314,798; 5,320,938; and 5,356,764; and high chloride [111] tabular grain emulsions, as is described in U.S. Pat. Nos. 5,264,337 and 5,292,632. Particularly advantageous would be the use of silver chloride emulsions which have up to 1.0% iodide such as described in U.S. patent application Ser. No. 94/362,283 by Chen et al entitled "Cubical Silver Iodochloride Emulsions, Processes For Their Preparation And Photographic Print Elements" filed Dec. 22, 1994.

The process of adding silver bromide to an emulsion during finishing of the invention may be utilized with a variety of conventional finishing materials. Various sensitizing dyes for silver halide emulsions are well known in the art. Typical of such materials are those disclosed in Research Disclosure 308119 of December 1989, Section IV. The emulsions also are subjected to chemical sensitization, preferably by gold/sulfur sensitization. Other chemical sensitizations may be utilized such as those set forth in Section III, page 996, of Research Disclosure 308119 of December 1989. Also, particularly advantageous would be the use of gold only sensitization by the use of aurous bis(1,4,5-trimethyl- 1,2,4-triazolium-3-thiolate)tetrafluoroborate as disclosed in U.S. Pat. No. 5,049,485.

Further, it is contemplated that the invention may be utilized with conventional color paper base materials. Such materials generally comprise paper that has been coated with a layer of polyethylene, as well as a reflective layer as known in the art. For instance, Research Disclosure 18716 of November 1979 describes useful embodiments which are herein incorporated by reference.

The invention may be utilized for the addition of any photographically useful group to a silver halide emulsion. Typical of photographically useful groups suitable for the invention are additives such as UV absorbers, sensitizing dyes, brighteners, luminescent dyes, supersensitizers, stabilizers, light absorbing and scattering materials, coating aids, plasticizers, lubricants, and antistats.

Dopants in concentrations of up to $1\times10^{-2}$ moles per silver mole and typically less than $1\times10^{-4}$ moles per silver mole, can be present in the final emulsion. The dopant can be added during the formation of the host high chloride emulsion, during the finishing step or even by incorporation of dopant into the fine-grain (Lippmann) silver halide used as a carrier for the photographically useful ingredient. Compounds of metals such as copper, thallium, lead, bismuth, mercury, zinc, cadmium, rhenium and Group VIII metals (e.g., iron, ruthenium, rhodium, palladium, osmium, iridium and platinum) may be used. Photographic properties of the final emulsion may be altered by the level and/or location of the dopant or combinations thereof. The metal dopant compounds used can be simple salts or coordination complexes such as hexacoordination or tetracoordination complexes with ligands such as halo, aquo, cyano, cyanate, thiocyanate, nitrosyl, oxo and carbonyl ligands, or combinations thereof. Dopants can be included within the emulsion grain by addition during grain formation, or be added subsequently during the finishing step. Useful dopants and methods of incorporation into silver halide emulsions are disclosed in Research Disclosure Item 37038, Section XV B of February 1995. Specifically, salts and complexes of transition metals such as Ir, Os, Ru, and Fe are specifically contemplated.

The invention finds its preferred use in the addition of antifoggants. Typical of such antifoggants are those disclosed in Section VIII of Research Disclosure 36544 published September 1994. Preferred for utilization with the silver chloride emulsions of the invention are the mercaptan antifoggants of the general structure

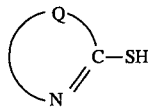

AF-1 wherein Q represents the atoms necessary to complete a five- or six-membered heterocyclic nucleus. Exemplary preferred heterocyclic nuclei include tetrazoles, triazoles, imidazoles, oxadiazoles, thiadiazoles and benzothiazoles.

In a preferred embodiment, the mercaptan compound has one of the following structures:

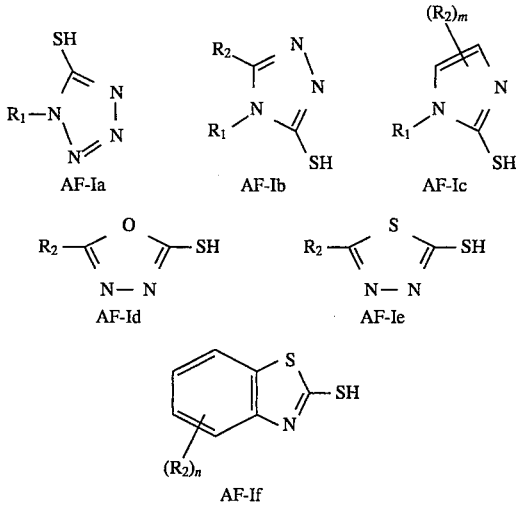

wherein $R_1$ is selected from hydrogen, alkyl, aryl, carbonamido, sulfonamido, alkenyl, cycloalkyl, cycloalkenyl, alkinyl, sulfonyl, sulfinyl, phosphonyl, acyl, carbamoyl, sulfamoyl, amino, alkylamino, anilino, imido, ureido, sulfamoylamino, alkoxycarbonylamino, aryloxycarbonylamino, alkoxycarbonyl, aryloxycarbonyl; $R_2$ is selected from the same substituents as $R_1$ and halogen, alkoxy, aryloxy, siloxy, acyloxy, carbamoyloxy; m=0–2; and n=0–4.

Preferred antifoggants are arylmercaptotetrazoles of the general formula AF-Ia ($R_1$=aryl). Particularly preferred antifoggants are 1-(3-acetamidophenyl)- 5-mercaptotetrazole, 1-(3-benzamidophenyl)-5-mercaptotetrazole, and 1-(3-(2-hydroxy)benzamidophenyl)- 5-mercaptotetrazole.

Further antifoggants such as p-toluene thiosulfonate (commonly used with p-toluene sulfinate) are specifically contemplated to be incorporated into emulsion grains by use of fine grain Lippmann silver as is described by the invention.

The Lippmann emulsions of the invention are generally formed by the conventional double jet with precipitation temperatures of about 40° C. The fine grain Lippmann emulsions may be utilized either in the washed or unwashed state. The temperature of about 40° C. during formation is preferred in order-to form the small size grains required. The fine grain Lippmann emulsion is mixed with an appropriate amount of the photographically useful material. The combination of the fine grain Lippmann emulsion and the photographically useful material may be carried out immediately after formation of the Lippmann emulsion prior to cooling and storage, or it may be added after the Lippmann emulsion is melted and immediately prior to use in the finishing process for the chloride emulsion. The invention finds its preferred use with the antifoggants as above set forth. It is believed that these materials are preferred, as they will adhere to the surface of Lippmann emulsion and, therefore, be carried directly to the silver halide grain for deposit thereon with the silver bromide of the Lippmann emulsion.

In an alternative embodiment, it is also a preferred embodiment to add spectral sensitizing dye to the Lippmann emulsion alone or in combination with the antifoggant. In the most preferred embodiment of the invention wherein the mercaptotetrazole antifoggant is added by the invention process, it has been found that the amount of Lippmann emulsion needed to provide the required amount of silver bromide to the surface of the grain does not provide sufficient surface area for the total antifoggant that is desirably to be added to the chloride emulsion. Therefore, a portion of the antifoggant is added in the conventional manner during finishing as a separate addition, while additional antifoggant is carried in with the Lippmann emulsion.

Surprisingly it has been found that when even a portion of the antifoggant is brought in with the Lippmann bromide, the fog level of the emulsion is lowered beyond what the fog level would be if the entire mercaptotetrazole antifoggant had been applied separately during the finish. While the proportion of the amount of antifoggant carried in with the Lippman emulsion versus the amount of antifoggant added conventionally will vary depending on the effectiveness of the antifoggant, it has generally been found to be effective to bring between 1 and 20 percent of the total antifoggant into the emulsion with the Lippmann emulsion in order to obtain the improved fog performance by the use of the fine grain emulsion. Generally the maximum amount of antifoggant that can be adhered to by the fine grain bromide emulsion will be utilized.

While the invention has been described with utilization of Lippmann bromides as the carrier for the photographically useful material, it is contemplated by the invention that the fine grain emulsion could be a silver chloride emulsion which would have the advantage that a larger amount of Lippmann emulsion could be utilized, as it would deposit in such a way as to not significantly modify the halide composition of the host silver chloride emulsion. Therefore, the use of such a chloride would allow the entire photographically useful material to be transferred to the host silver chloride grain for maximum advantage. Some could be adhered to the fine grain silver chloride and some adhered to a fine grain silver bromide.

While it has been described that the antifoggant is partially introduced by direct addition and partially by being carried by the Lippmann emulsion, it is possible that the antifoggant material not adhered to the fine grain emulsion may be added at different times during the sensitization of the chloride emulsion than the fine grain emulsion. The benefit of the invention is obtained regardless of the order of addition of the conventionally added antifoggant and the Lippmann carried antifoggant. The antifoggant not carried to the silver chloride emulsion by the silver bromide Lippmann emulsion may be added either during the finish cycle, during melting of the emulsion immediately prior to coating, or to the coupler dispersion. If added during the finish heat cycle, it may be carried by silver chloride to which the antifoggant is adhered.

The following examples illustrate the practice of this invention. They are not intended to be exhaustive of all possible variations of the invention. Parts and percentages are by weight unless otherwise indicated.

Silver Chloride Emulsion Precipitation

This emulsion was a conventional, cubic silver chloride emulsion precipitated in a bone gelatin and containing no intentionally added bromide or iodide during the grain formation process. It was precipitated by the simultaneous addition of silver nitrate (solution 2) and sodium chloride (solution 3) into a well-stirred reactor (solution 1) containing an aqueous gelatin solution of sodium chloride, thioether ripener at a temperature of 68.3° C., and the pCl was approximately 1.0.

(Solution 1):

5314 cc of water
200.8 grams of gelatin
32.7 grams of sodium chloride
1.65 grams of thioether ripener (I)
temperature held at 68.3° C.

(Solution 2):

1698.9 grams of silver nitrate
2354 cc of water (Solution 3 ):

666.2 grams of sodium chloride
2763 cc of water

The total precipitation time was 35.7 minutes, the first 5.25 minutes of which the silver addition rate was 0.0867 moles per minute. After 5.25 minutes, the silver nitrate addition was ramped up (0.0867 to 0.412 moles per minute) over 19 minutes, then held at a constant rate of 0.412 moles per minute for 11.7 minutes. Salt was added at a nearly equimolar amount for the first 1.25 minutes of the precipitation, and after 1.25 minutes in a manner to maintain the pCl at approximately 1.0 during the remainder of the precipitation. After a total of 10.0 moles of silver chloride was precipitated, the emulsion was desalted by diafiltration and the final emulsion pH and pAg were adjusted to 5.5 and 1.7 respectively. The emulsion grain size was determined to be approximately 1.0 micrometer in cubic edge length.

Sensitization of the Silver Chloride Emulsion

Samples of the emulsion were optimally sensitized using a common sensitization scheme. The primary difference among the emulsion sample sensitizations was in the level of antifoggant/stabilizer added, or in the manner of its introduction.

(Sensitization A):

(a) Emulsion was melted at 40° C.

(b) Emulsion pH was 5.5.

(c) Emulsion pCl was adjusted to 1.5.

(d) 1.8 mg/mole of colloidal gold sulfide was added and the temperature was raised to 65° C.

(e) 258 mg/mole of sensitizing dye SD-1 was added after 18 min. at 65° C.

(f) 57.2 mg/mole of antifoggant/stabilizer AF was added after 35 min. at 65° C.

(g) 0.03 mg/mole of potassium Ir(IV) hexachloride was added as an aqueous solution after 43 min. at 65° C.

(h) A fine grain silver bromide (0.05–0.1 micron) was added (1.0 mole % of the total silver) to the silver chloride emulsion after 45 min. at 65° C.

(i) After 65 min. at 65° C., the emulsion was cooled back to 40° C.

(Sensitization B):

The same as sensitization A above except that the level of antifoggant/stabilizer AF was 80.0 mg/mole.

(Sensitization C):

The same as sensitization A above except that in addition to the 57.2 mg/mole of antifoggant/stabilizer AF, an additional 10.3 mg/mole of AF was carried into the silver chloride emulsion with the fine grain silver bromide. The antifoggant/stabilizer AF was premixed with the fine grain silver bromide at 40° C. and held prior to its addition to the chloride emulsion.

Format for Emulsion Performance Evaluation

A multicolor, multilayer coating format was prepared as the photographic recording element of this invention using the following structure:

| |
|---|
| gel overcoat |
| Red sensitive/cyan dye imaging silver halide layer |
| interlayer |
| Green sensitive/magenta dye imaging silver halide layer |
| interlayer |
| Blue sensitive/yellow dye imaging silver halide layer |
| reflection support |

Photographic Comparisons

Each of the optimally sensitized emulsions (sensitizations A, B and C) was coated as a blue sensitive/yellow dye imaging silver halide layer coated at 26 mg of silver per square foot along with a coupler YC level of 100 mg per square foot. The other imaging layers (red/cyan and green/magenta), interlayers and gelatin overcoat remained constant in the multicolor multilayer coating. All layers in the coating were hardened with bis-(vinylsulfonylmethyl)ether. Coatings were exposed with a 3000° K. tungsten light source through a blue filter (a combination Wratten 48+2B) for 0.5 seconds. Coated samples were processed in Kodak EKTACOLOR RA-4 processing chemistry in a roller transport processor. Coating performance was determined by measuring photographic speed/sensitivity in relative Log exposure units at a density=0.8, shoulder density at +0.4 Log E higher exposure, and toe density at 0.2 Log E lower exposure than the speed point. Dmin or fog level was the lowest density measured in unexposed, processed areas of the coating. Fresh (non-incubated) response, as well as incubated response (28 days at 120° F.), was measured.

Table I compares the performance of the three emulsion sensitizations.

TABLE I

| Emulsion sensitization | A | B | C (invention) |
|---|---|---|---|
| Fresh speed/sensitivity | 1.23 | 1.22 | 1.22 |
| Fresh shoulder density | 1.62 | 1.75 | 1.53 |
| Fresh toe density | 0.19 | 0.19 | 0.20 |
| Fresh Dmin (fog) | 0.104 | 0.099 | 0.103 |
| Incubation speed change | +0.22 | +0.24 | +0.02 |
| Incubation shoulder change | −0.07 | −0.11 | −0.004 |
| Incubation toe change | +0.08 | +0.08 | 0.00 |
| Incubation Dmin change | +0.070 | +0.076 | +0.017 |

As can be seen in Table I, the Example C of the invention provides a significant increase in performance of the emulsion for all four incubation measurements.

APPENDIX

Thioether Ripener $HOCH_2CH_2$-S-$CH_2CH_2$- S-$CH_2CH_2OH$

SD1

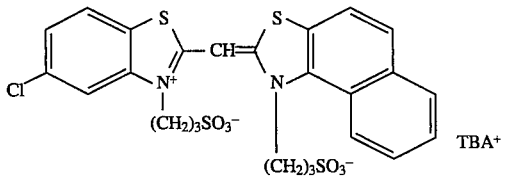

-continued

AF

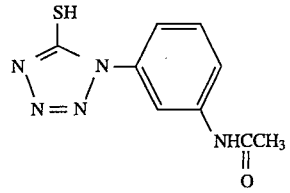

YC

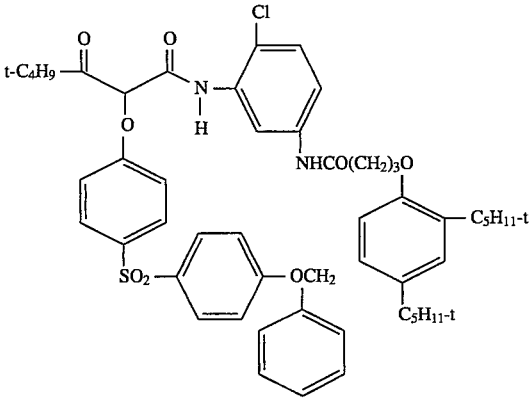

The invention has been described in detail with particular reference to preferred embodiments thereof, but it will be understood that variations and modifications can be effected within the spirit and scope of the invention.

We claim:

1. A method of silver halide grain finishing comprising providing a high chloride silver halide emulsion and adding a silver halide fine grain emulsion during a chemical sensitization heat cycle for said high chloride silver halide emulsion wherein said fine grain emulsion has a photographically useful compound adhered to surface of the grains of said fine grain emulsion wherein said photographically useful compound is selected from the group consisting of UV absorbers, sensitizing dyes, brighteners, antifoggants, luminescent dyes. supersensitizers, stabilizers, light absorbing and scattering materials, coating aids, plasticizers, lubricants, and antistats.

2. The method of claim 1 wherein said photographically useful compound comprises an antifoggant.

3. The method of claim 1 wherein said high chloride emulsion comprises at least about 95 mole percent chloride.

4. The method of claim 1 wherein the silver halide content of said fine grain emulsion comprises greater than about 98 mole percent silver bromide.

5. The method of claim 1 wherein fine grain silver bromide is added during the heat cycle.

6. The method of claim 1 wherein said fine grain emulsion comprises silver bromide.

7. The method of claim 1 wherein said fine grain emulsion comprises silver chloride.

8. The method of claim 1 wherein said fine grain emulsion comprises both silver chloride and silver bromide fine grains.

9. The method of claim 6 wherein said photographically useful compound comprises a mercaptotetrazole antifoggant.

10. The method of claim 6 wherein said fine grain emulsion has an average size of between 0.03 and about 0.1 microns.

11. The method of claim 1 wherein said fine grain emulsion is added prior to spectral sensitizing dye during an increased temperature portion of the chemical sensitization heat cycle.

12. The method of claim 1 wherein said high chloride silver halide emulsion is tabular and has a size of between about 0.5 and 3.5 micron ECD.

13. The method of claim 1 wherein said high chloride emulsion is cubic and has an average size of between 0.2 and 1.5 microns.

14. The method of claim 1 wherein the silver halide comprising said fine grain emulsion and said photographically useful compound are both deposited onto the surface of silver halide grains of said high chloride emulsion.

15. The method of claim 14 wherein the depositing takes place during said heat cycle.

* * * * *